US005450117A

United States Patent [19]

Quanz

[11] Patent Number: 5,450,117

[45] Date of Patent: Sep. 12, 1995

[54] DEVICE FOR PRODUCING A SLIDE

[75] Inventor: Gerhard Quanz, Eichenzell, Germany

[73] Assignee: Eastman Kodak Company, Rochester, N.Y.

[21] Appl. No.: 84,372

[22] Filed: Jun. 29, 1993

[30] Foreign Application Priority Data

Jul. 10, 1992 [DE] Germany ..... 42 22 722.4

[51] Int. Cl.[6] ..... B41J 17/32

[52] U.S. Cl. ..... 347/217; 346/134

[58] Field of Search ..... 346/134, 76 PH, 76 L, 346/108; 503/227; 400/237, 240, 240.3, 240.4, 228; 347/217

[56] References Cited

U.S. PATENT DOCUMENTS

| | | | |
|---|---|---|---|
| 4,567,114 | 1/1986 | Oshima et al. | 428/480 |
| 5,017,547 | 5/1991 | Deboer | 503/227 |
| 5,017,943 | 5/1991 | Ogita et al. | 400/228 |
| 5,066,962 | 11/1991 | Sarraf | 346/76 L |
| 5,105,206 | 4/1992 | Sarraf et al. | 346/76 L |
| 5,342,817 | 8/1994 | Sarraf | 503/227 |

FOREIGN PATENT DOCUMENTS

| | | | |
|---|---|---|---|
| 0160161 | 9/1983 | Japan | 400/228 |
| 0064268 | 3/1994 | Japan | 400/228 |

*Primary Examiner*—Huan H. Tran
*Attorney, Agent, or Firm*—Dennis R. Arndt

[57] ABSTRACT

A device for producing a slide by a three-color printing process wherein ink is transferred according to the thermal transfer printing method from a ribbon-type ink carrier onto a record carrier in the form of a transparent sheet, the ribbon-type ink carrier carrying successively arranged magenta, yellow and cyan colored ink fields being slidably guided in a slide mount across the record carrier also arranged in the mount. In the initial position of the ink carrier, the first ink field is positioned opposite the record carrier for the first ink transfer. The further ink fields can be successively aligned with the record carrier for each further ink transfer. The slide mount is loaded with the record carrier and the ink carrier is placed in a holding device of the transfer station of a thermal transfer printing apparatus where the ink is transferred by means of an infrared laser focused in the ink plane of the ink carrier. The ink carrier is transported by means of a motor drive.

6 Claims, 6 Drawing Sheets

DEVICE FOR PRODUCING A SLIDE

BACKGROUND OF THE INVENTION

The invention relates to a device for producing a slide by transferring ink from an ink carrier onto a record carrier by means of thermal energy.

Apparatus for making color prints by the thermal transfer printing process are commercially available. The prints are produced using three inks of the primary colors yellow, magenta and cyan. These inks are successively arranged on a ribbon. Three successive printing operations are required in order that the heated resistances of a thermal printhead cause the dye pigments to dissolve and to be transferred in a diffusion process to a specialty paper or, if transparent originals are used, to a transparent sheet.

Also known from the prior art (DE-PS 33 15 265) are thermal transfer systems with an ink carrier which consists of paper, textile or plastic sheet material which is coated with a thermofusible or sublimatable ink layer.

DE-OS 36 23 487 discloses a thermal transfer printing apparatus wherein ink from a carrier (ribbon) with sections of each of the primary colors black, cyan, magenta and yellow is locally transferred in that the ribbon is locally heated by means of a radiation source of high intensity, e.g. a laser.

SUMMARY OF THE INVENTION

It is the object of the invention to provide a device for producing slides by simple means using the thermal ink transfer process.

According to the invention this object is attained in that a transparent record carrier is held in a slide mount, in that a ribbon-type ink carrier with successively arranged magenta, yellow and cyan colored ink fields is shiftably guided in said slide mount, in that in the initial position, a first ink field is aligned with the record carrier and in that the other ink fields can be successively aligned with said record carrier.

According to an advantageous modification the ink carrier consists of a rectangular ribbon which is provided with edge perforations and is directly coated with the successively arranged ink fields.

According to a further advantageous modification the ink carrier is provided with successively arranged punched rectangular openings which are slightly larger than conventional image frames of the 24×36 mm format and are lined underneath by sections provided with ink fields and attached to the lower side of the ink carrier.

In detail the invention is such that the ribbon-type ink carrier comprises a guide section located in front of the first ink field as well as an end section located after the third ink field, in that in the initial position of the ink carrier in the slide mount, the guide section projects from the transverse front edge of the mount and in that the slide mount loaded with the transparent record carrier and the ink carrier can be inserted into a holding device of the transfer station of a thermal transfer printing apparatus in which the guide section is held in engagement with a transport means which shifts the ink carrier in the slide mount.

The advantage attained by the invention consists in that each slide mount which is loaded with a record carrier and into which a ribbon-type ink carrier has been shifted forms a unit and that if a number of slide mounts are stacked for example the number of slide mounts with record carriers and the number of ink carriers are always identical.

The invention will now be explained in further detail with reference to two embodiments illustrated in the drawing in which identical parts have the same reference numerals, and wherein:

DETAILED DESCRIPTION

Figure 1:
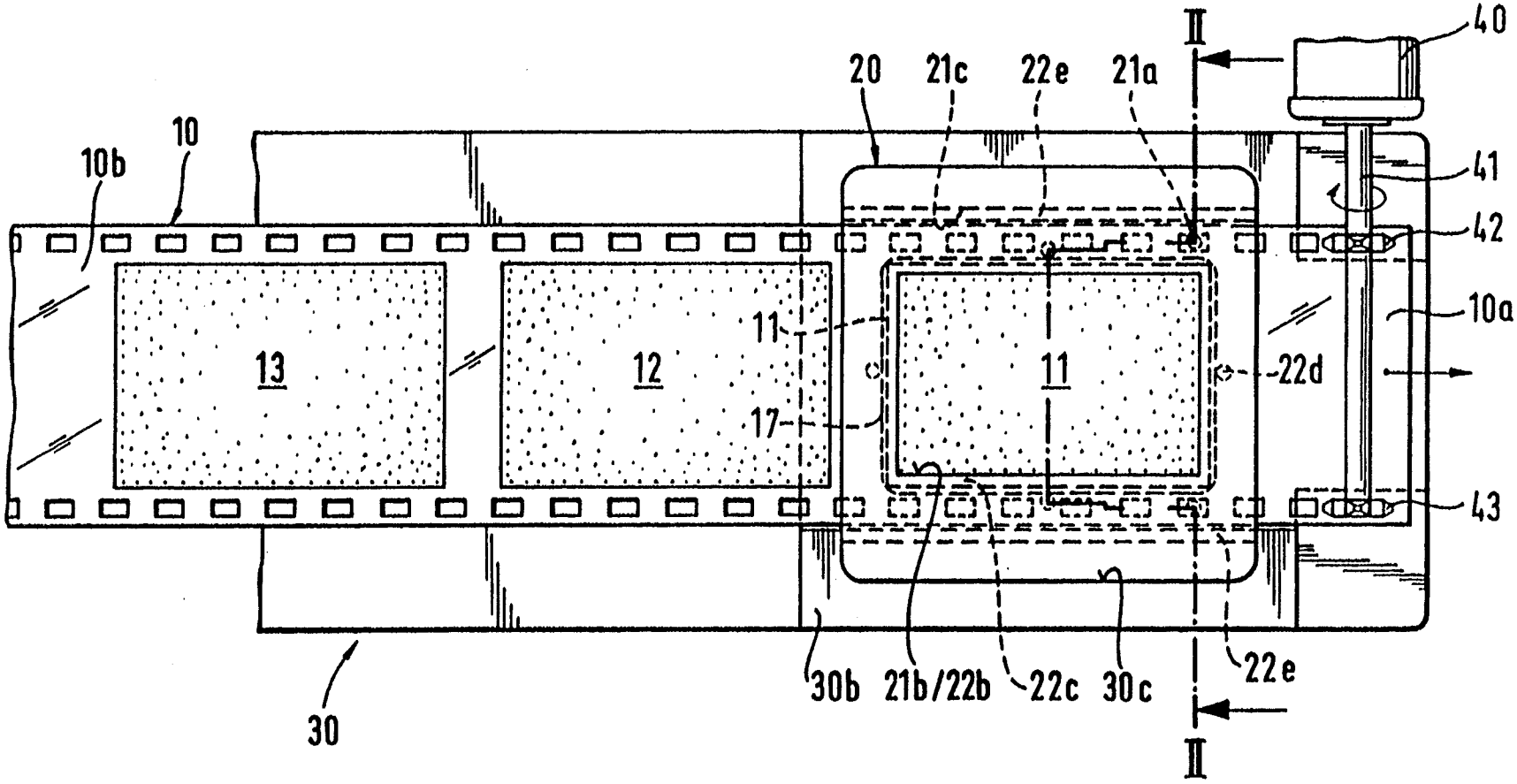
FIG. 1 is a plan view of a slide mount consisting of two parts and loaded with a record carrier and an ink carrier according to the first embodiment, the mount being shown within a partially illustrated holding device of a thermal transfer printing apparatus.

A transparent ink carrier 10 as shown in FIG. 1 consists of a rectangular ribbon preferably sized 38×190 mm and provided at its lateral edges with perforations similar to those of 35-mm film. The carrier is directly coated with a succession of ink fields 11, 12 and 13 in the complementary colors of magenta, yellow, and cyan and shiftably guided in a two-part slide mount 20. The ink carrier 10 comprises a guide section **10*a* located in front of its first ink field 11 and an end section 10*b* located after its third ink field 13**.

The two-part slide mount 20 consists of an upper portion 21 which can be interlocked with a lower portion 22.

Figure 2:
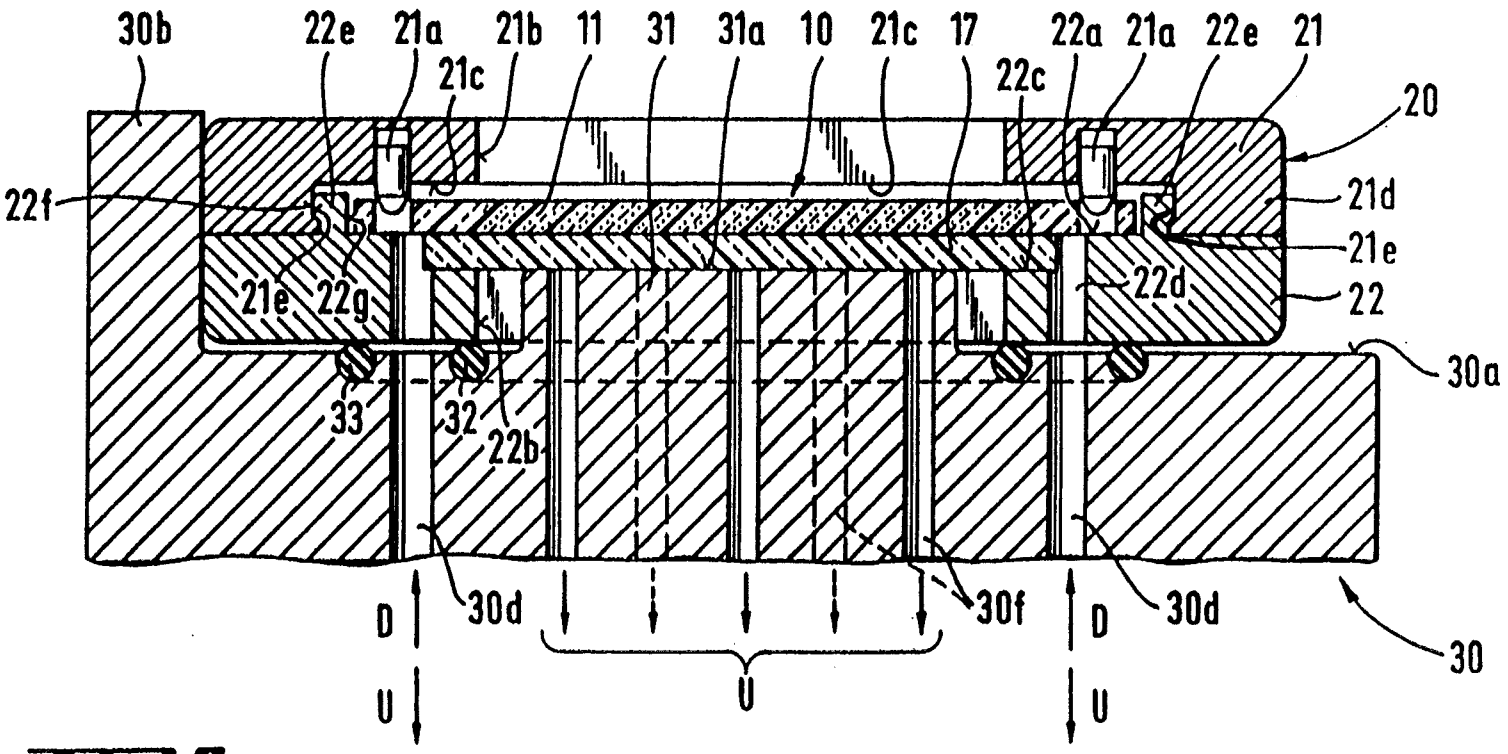
FIG. 2 shows the holding device with the two-part slide mount according to FIG. 1 in a section along line II—II.
Figure 6:
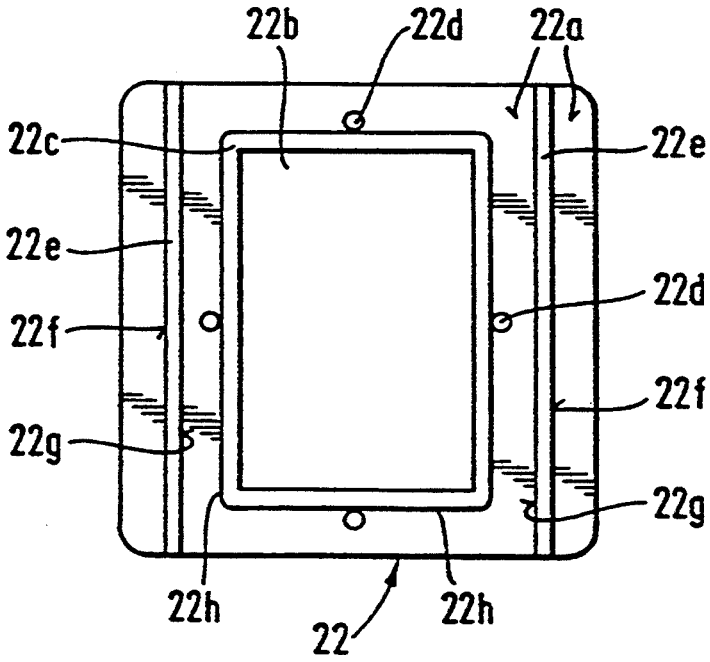
FIG. 6 is a plan view of the lower portion of the slide mount according to FIGS. 1 and 2.
Figure 7:
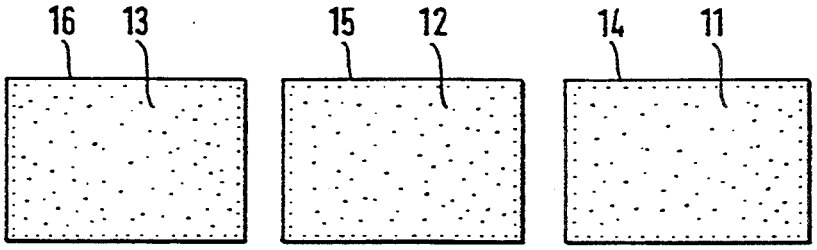
FIG. 7 shows three individual sections provided with ink fields for a second embodiment of an ink carrier.

As illustrated in FIGS. 2 and 6, lower portion 22 has an inner surface **22*a* which faces the upper portion 21 and in the area of the image window 22*b* has a stepped rim 22*c* formed by a cut-out and surrounding the image window 22*b***.

Four bores **22*d* extending from the inner surface 22*a* towards the exterior are arranged in the central area of each of the four mount-sections surrounding the image window 22*b* and are tangentially contacted by the edge 22*h* of the stepped circumferential rim 22*c*. Moreover the two longer mount sections of the lower portion 22 each have a rib 22*e* molded to the inner surface 22*a* and extending between the two longer lateral edges of the image window 22*b*** and the two outer edges of the lower portion, which are parallel thereto.

Figure 5:
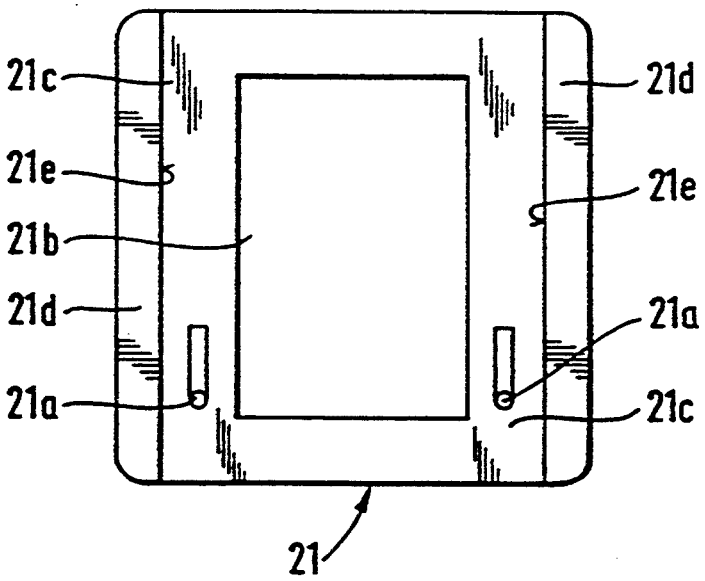
FIG. 5 is a view from below of the upper portion of the two-part slide mount according to FIGS. 1 and 2.

As can be inferred from FIGS. 2 and 5, upper portion 21 has a cut-out 21*c* extending in the longitudinal direction of its image window 21*b* across the total length of the mount. The cut-out has a width such that two lateral webs 21*d* are defined. The facing inner surfaces 21*e* of webs 21*d* and the outer surfaces 22*f* of the two ribs 22*e* of lower portion 22 are designed such that they are locked when the upper portion 21 of the mount is pressed onto the lower portion 22.

Before the two mount portions 21 and 22 are locked, a record carrier 17 consisting of a transparent sheet or plate is placed on the stepped rim 22*c* of lower portion 22, which surrounds the image window 22*b*. The record carrier 17 is bonded to the stepped rim 22*c* at least at one point.

When the portions 21 and 22 are locked together a channel is formed between them by the cut-out 21*c* in upper portion 21 and the area defined by the ribs 22*e* in the inner surface 22*a* of lower portion 22 into which the aforedescribed ink carrier 10 is shifted. On its lower side facing the record carrier 17 placed in the mount, the ink carrier 10 has a matte, finely structured surface and, as shown in FIG. 2; it is shiftably guided between the facing inner surfaces 22*g* of the two ribs 22*e* of lower portion 22.

In order to hold ink carrier 10 in its position, a resilient finger 21*a* each is arranged adjacent to the two lateral webs 21*d* of upper portion 21 such that it engages the edge perforation of ink carrier 10 with its rounded tip.

Figure 4:
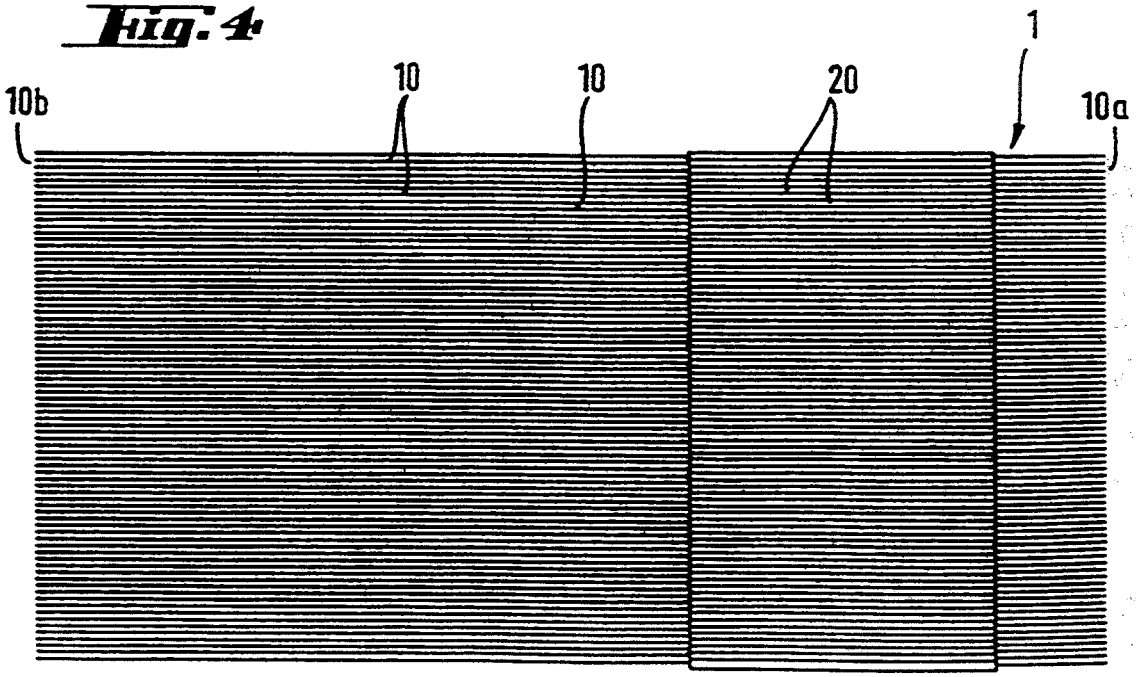
FIG. 4 shows a stack of slide mounts loaded with a record carrier and an ink carrier according to FIG. 1.

FIG. 4 shows a stack of slide mounts 20 each loaded with a transparent record carrier 17 and an ink carrier 10. Stack 1 is stored within the closed housing of a thermal transfer printing apparatus on a vertically movable lifting platform. Each uppermost slide mount of the stack is placed fully automatically by suitable means into the holding device 30 of a transfer station of the thermal transfer printing apparatus.

Figure 3:
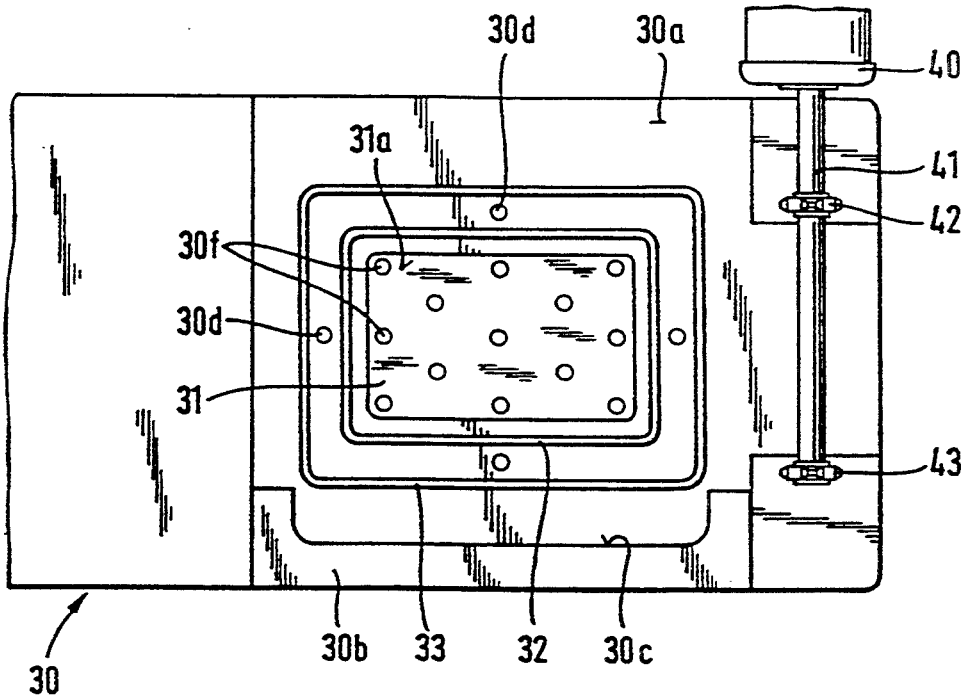
FIG. 3 is a plan view of the holding device according to FIG. 1 without the slide mount.

Holding device 30 which is illustrated in FIGS. 1 to 3 comprises a support surface 30a for the slide mount 20 and a rectangular projection 31 which extends into the image window 22*b* in the lower portion 22 of slide mount 20. Projection 31 is surrounded by two spaced flexible seals 32 and 33 inserted in, and slightly projecting from the support surface 30*a*. Between the two circumferential seals 32 and 33, four air ducts 30*d* terminate in support surface 30*a*. A number of additional uniformly distributed air ducts 30*f* terminate in surface 31*a* of projection 31.

The four air ducts 30*d* are connected with a first air conduit system (not illustrated) whereas the greater number of further air ducts 30*f* is connected with a second air conduit system (not illustrated either). Moreover a lateral abutment member 30*b* projects upwardly from the support surface 30*a* in parallel with the rectangular projection 31 and has an abutment surface 30*c* whose shape and size are adapted to part of the slide mount 20.

A slide mount 20 inserted into holding device 30 is fixed in position on the abutment surface 30*c* of abutment member 30*b* (FIGS. 1 and 3). It rests on the two halves of the flexible seals 32 and 33 which slightly project from support surface 30*a*. As was described above, the rectangular projection 31 is received in the image window 22*b* of lower portion 22, with its plane surface 31a being substantially flush with, or slightly lower than the stepped rim 22*c* of portion 22, by which image window 22*b* is surrounded.

As shown in FIG. 2, the record carrier 17 received in the circumferential stepped rim 22*c* of lower portion 22 rests on the plane surface 31*a* of projection 31 and covers the bores of the greater number of air ducts 30*f*. The four air ducts 30*d* which are situated between the circumferential seals 32 and 33 are distributed such that they are substantially aligned with the four bores 22*d* located in the lower portion 22 of the slide mount.

Reference numeral 40 denotes a stopping motor (FIGS. 1 and 2) whose driving shaft 41 carries two indexing wheels 42 and 43. As can be seen from FIG. 1, when ink carrier 10 is in its initial position in slide mount 20, its first magenta colored ink field 11 is positioned opposite the transparent record carrier 17. Guide section 10*a* of ink carrier 10 projects from the transverse front edge of slide mount 20 and during insertion of the slide mount 20 into the holding device 30, its perforations are brought into engagement with the indexing wheels 42 and 43.

The device functions as follows:

After a slide mount 20 loaded with record carrier 17 and ink carrier 10 has been automatically inserted into the holding device 30 a slide is produced in that three successive ink transfers are carried out. The electronic control operations and control means required for this purpose do not form part of the invention and for that reason are not described in detail.

Prior to the first ink transfer both air conduit systems are subjected to a vacuum "U". Air is sucked in through all of the air ducts 30*d* and 30*f*. Through the four bores 22*d* of lower portion 22, which are aligned with the four air ducts 30*d*, the area of the ribbon-type ink carrier 10, which is coated with the first ink field 11 (magenta), is attracted to record carrier 17 which in turn is attracted to the plane surface 31*a* of projection 31 (FIGS. 1 and 2) via the other air ducts 30*f*. As a result the whole surface of the ink carrier area coated with ink field 11 is placed into contact with record carrier 17. The flexible seals 32 and 33 serve as air seals.

Now the first ink transfer is carried out, the required high resolution being attained by an infrared laser (not illustrated) which is focused in the ink plane of ink carrier 10. In the case of the present sublimation process the ink is directly converted from its solid to its gas phase by the dot-scanning action of the laser energy and condenses on the record carrier 17 where it diffuses into the coating of the record carrier 17 under the action of heat and is thus fixed so that it cannot be wiped off.

Subsequently the vacuum "U" in the first air conduit system is rendered inoperative and pressurized air "D" blown through the four air ducts 30*d*. Since the vacuum "U" in the second air conduit system is maintained and record carrier 17 continues to be attracted to the plane surface 31*a* of projection 31 the area coated with the ink field 11 on ink carrier 10 is separated from the record carrier 17 by the temporary introduction of pressurized air so that the ink carrier 10 rests only loosely on the record carrier 17 and can again be shifted.

After the first ink transfer has been completed in the manner essentially outlined above, the stepping motor 40 is put in operation and the ink carrier 10 pulled through slide mount 20 by the motor-driven indexing wheels 42 and 43 until the second, yellow colored ink field 12 has been positioned opposite record carrier 17. The resilient fingers 21*a* of upper portion 21, which engage the edge perforation of the ink carrier 10, serve to hold the ink carrier 10 in its position when it is arrested.

Prior to the second ink transfer another vacuum "U" is produced in the first air conduit system and the ink carrier 10 is attracted to the record carrier 17 in the area of its yellow-colored second ink field 12. The separation of the ink carrier 10 from the record carrier 17 at the end of the second ink transfer as well as the further transport of ink carrier 10 and the third ink transfer are performed in a manner analogous to that of the first ink transfer.

After the third ink transfer and the last transport of ink carrier 10 have been terminated part of the end section **10*b* following the third ink field 13 remains in slide mount 20. The user can remove the ink carrier 10 from the slide mount 20** and dispose of it.

Since upon transfer of the inks from the ink fields 11, 12 and 13 onto record carrier 17 the ink fields comprise the corresponding negative images it is advisable to store the ink carrier 10 if necessary or to destroy it if secrecy is required.

Another embodiment of an ink carrier is illustrated in FIGS. 7 to 10 in which the same reference numerals as in the first embodiment are used for identical parts.

Figure 8:
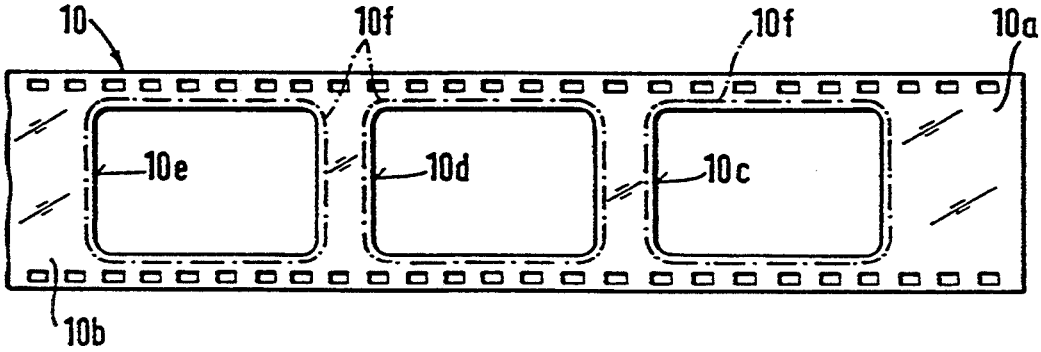
FIG. 8 is a plan view of the second embodiment of the ink carrier.

The transparent ink carrier 10 shown in FIG. 8 also consists of a rectangular ribbon sized 38×190 mm and having a perforation on either of its edges. It is provided with successively arranged rectangular punched openings **10*c*, 10*d*, 10*e*** which are slightly larger than the standard frame size of 24×36 mm.

These openings **10*c*, 10*d*, 10*e* are lined underneath by sections 14, 15 and 16 (FIG. 7) carrying ink fields 11, 12, 13 of magenta, yellow and cyan respectively and arranged on the lower side 10*g* of ink carrier 10. For this purpose the sections 14, 15, and 16 are also slightly larger than the punched openings 10*c*, 10*d* and 10*e*. For securing the sections 14, 15 and 16, narrow adhesive areas 10*f* can be provided parallely to the edges of the openings 10*c*, 10*d* and 10*e* on the lower side log of ink carrier 10 and the sections 11, 12, 13 which are slightly larger than the openings 10*c*, 10*d* and 10*e*** can be attached to them. However, they can also be attached in any other suitable manner.

Figure 9:
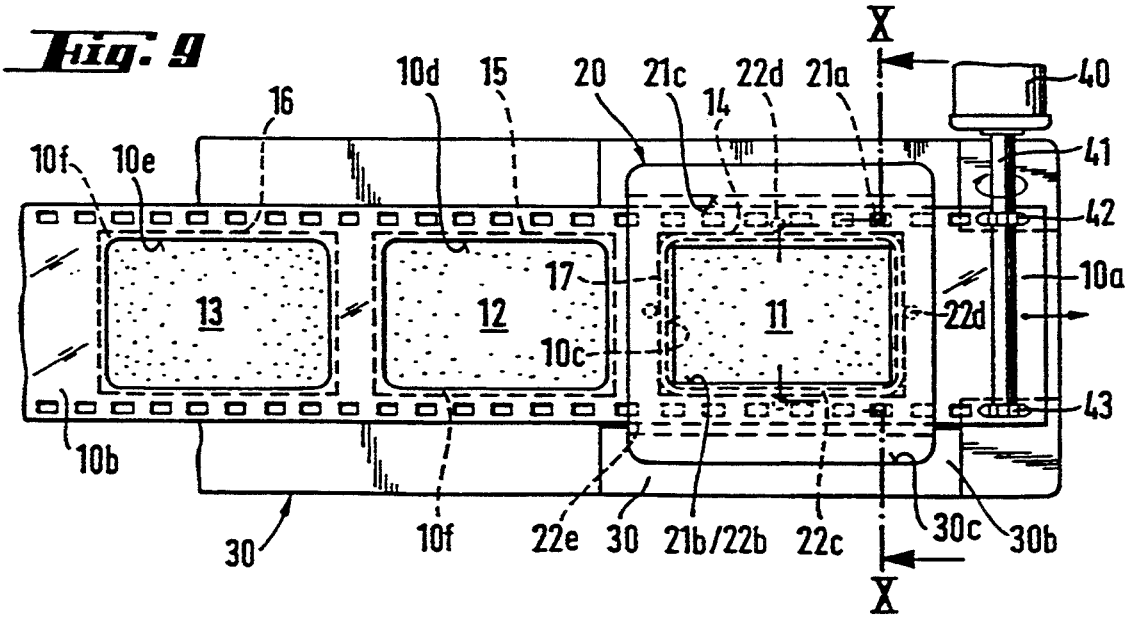
FIG. 9 is a plan view of the two-part slide mount loaded with the record carrier according to FIGS. 1 and 2 and the ink carrier according to FIGS. 7 and 8 in the partially illustrated holding device of the thermal transfer printing apparatus.
Figure 10:
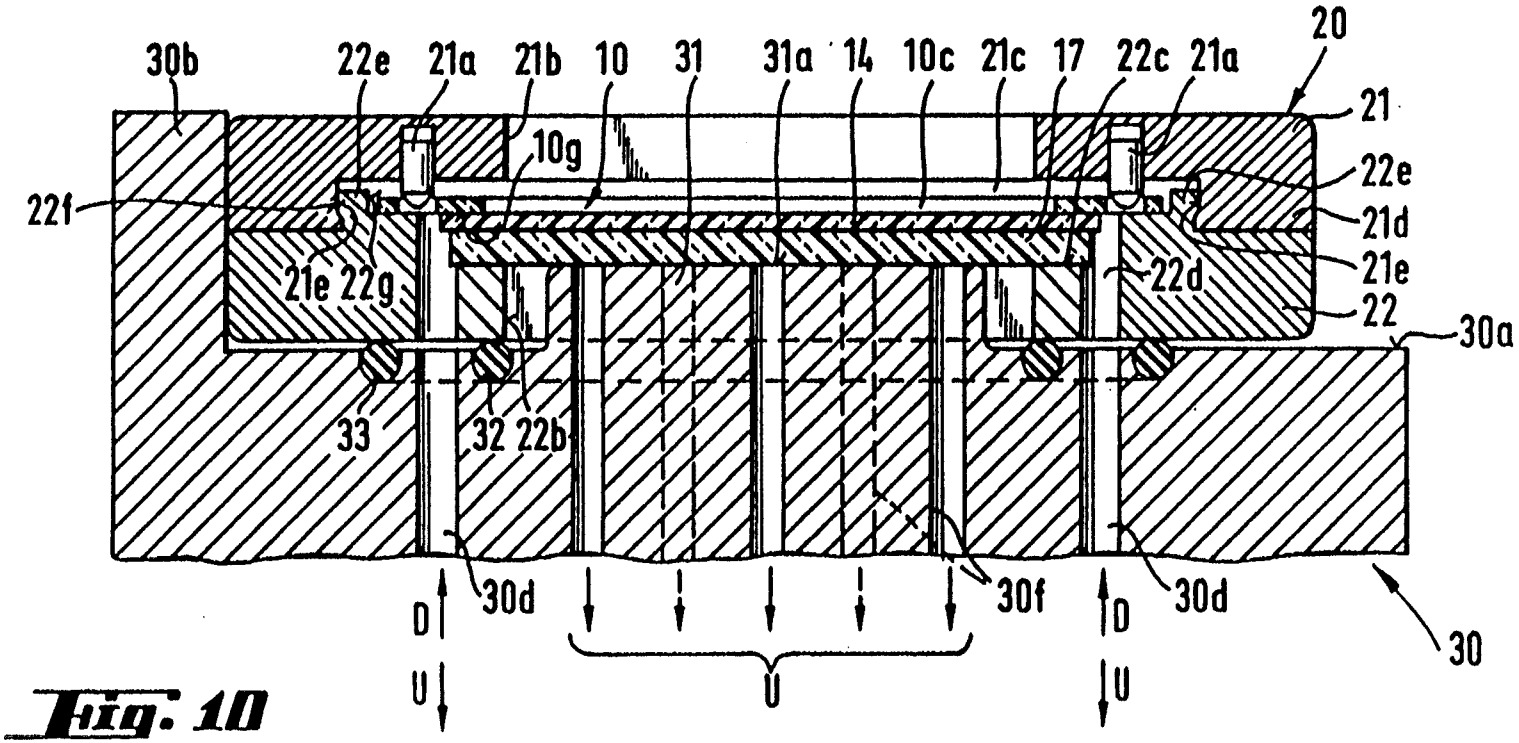
FIG. 10 shows the holding device with the two-part slide mount according to FIG. 9 in a section along line X—X.

As can be inferred from FIGS. 9 and 10, slide mount 20 which is adapted to receive the ink carrier 10 and the record carrier 17 is designed in the same way as the above-described slide mount for receiving the ink carrier according to the first embodiment and is referred to by the same numeral. This also applies to the holding device 30 of the transfer station of the thermal transfer printing apparatus which was also described above and is once again illustrated in FIGS. 9 and 10.

The invention has been described in detail with particular reference to certain preferred embodiments thereof, but it will be understood that variations and modifications can be effected within the spirit and scope of the invention.

| Parts List | |
|---|---|
| 10 | ink carrier |
| 10a | guide section |
| 10b | end section |
| 10c, 10d, 10e | rectangular punched openings |
| 10g | lower side, ink carrier |
| 11, 12, 13 | ink fields |
| 14, 15, 16 | sections |
| 17 | record carrier |
| 20 | slide mount |
| 21 | upper portion |
| 21a | resilient means |

-continued

| Parts List | |
|---|---|
| 21b | image window |
| 21c | cut-out |
| 21d | two lateral webs |
| 22 | lower portion |
| 22a | inner surface |
| 22b | image window |
| 22c | stepped rim |
| 22d | four bores |
| 22e | rib |
| 22g | inner surfaces |
| 22h | edge |
| 30 | holding device |
| 30a | support surface |
| 30b | lateral abutment member |
| 30c | abutment surface |
| 30d | air ducts |
| 30f | air ducts |
| 31 | rectangular projection |
| 32, 33 | flexible circumferential seals |
| 40, 41, 42, 43 | transport means |

What is claimed:

1. A device cooperable with a laser or thermal printhead for producing a slide by transferring ink from a ribbon shaped ink carrier with successively arranged, different color ink fields, onto a transparent record carrier held in an image window by a slide mount, which slide mount has guides for defining a path of movement for the ribbon shaped ink carrier across the image window, said device comprising:

means for holding a slide mount having slide mount guides and with a transparent record carrier held in an image window of the slide mount, and means for indexing a ribbon shaped ink carrier having successively arranged, different color ink fields as guided by the slide mount guides to successively align the different color ink fields with the transparent record carrier.

2. The device according to claim 1 further including means for applying and releasing a vacuum to both the ribbon shaped ink carrier and the transparent record carrier to hold them in a predetermined operative position with respect to each other.

3. The device according to claim 1 particularly for use with a ribbon shaped ink carrier having two longitudinal edges and a set of perforations along each longitudinal edge, wherein the means for indexing includes means for engaging both sets of perforations to successively align the different color ink fields with the transparent record carrier.

4. A slide mount comprising:

means defining an image window, a transparent record carrier positioned across the image window, and guide means defining a pair of opposing openings located on opposite sides of the image window through which a ribbon shaped ink carrier can be guided by the guide means as it is indexed through alignment with the image window and the transparent record carrier.

5. A slide mount according to claim 4 wherein the image window defining means has a stepped rim formed by a cutout that surrounds the image window and wherein the transparent record carrier is bonded to the stepped rim by an adhesive.

6. A slide mount according to claim 5 in which the slide mount consists of two flat, overlaid parts, and in which transparent the record carrier is bonded to one of the two parts and the guide means is at least partially defined by the other of the two parts.

* * * * *